United States Patent [19]

Phelps

[11] 4,314,243

[45] Feb. 2, 1982

[54] WELL PUMP THEFT ALARM

[76] Inventor: Clifford R. Phelps, P.O. Box 117, 183 Mayo Rd., Edgewater, Md. 21037

[21] Appl. No.: 127,037

[22] Filed: Mar. 4, 1980

[51] Int. Cl.[3] ..... G08B 21/00

[52] U.S. Cl. ..... 340/686; 166/66; 200/42 R; 200/61.58 R; 200/61.6; 200/61.93; 340/568

[58] Field of Search ..... 340/568, 686; 200/42 R, 200/61.58 R, 61.6, 61.93, 85 R; 116/85, DIG. 1; 166/66; 137/551, 554

[56] References Cited

U.S. PATENT DOCUMENTS 2,205,712 6/1940 Bitgood ..... 340/568 X 3,531,604 9/1970 Imburgia ..... 200/61.93 X 3,878,507 4/1975 Medlock ..... 340/568 X

*Primary Examiner*—John W. Caldwell, Sr.

*Assistant Examiner*—Joseph E. Nowicki

*Attorney, Agent, or Firm*—Schwartz, Jeffery, Schwaab, Mack, Blumenthal & Koch

[57] ABSTRACT

A submersible pump alarm includes an adapter in a well casing for receiving the well water pipe. An extension is threaded into the adapter and a switch inserted therein. A rod cooperates with a switch actuator and a cover on the casing, whereby when the cover is removed, bias which the rod exerts on the actuator is released and the switch energizes an alarm.

8 Claims, 4 Drawing Figures

WELL PUMP THEFT ALARM

BACKGROUND OF THE INVENTION

The invention relates to an alarm for use with submersible pumps of the type used to pump well water to a residence or the like.

In areas where public utility water is not available it is necessary to utilize well water. For many years it has been the practice to place a submersible pump in the well, as opposed to the older procedure of having the pump located above ground. A problem arises when it is necessary to replace or service the submersible pump. In the past, it has been necessary to first attempt to locate the well and then literally dig up the pump which can be fifty feet or more below ground level.

In more recent years it has become the practice to extend the well casing all the way to the surface of the ground and provide a well cap thereon. Thus, with the provision of a pitless adapter, it is possible to retrieve the submersible pump from the well without having to dig up the ground.

While this new procedure has made it earier and less expensive to retrieve the pump, it has permitted an increase in the number of thefts of well pumps since they are much more accessible than in the past.

PRIOR ART

Alarms have been provided for the detection of tampering or improper access. For example, U.S. Pat. No. 1,955,018 illustrates a manhole cover with means for detection of an explosion therein. When the manhole cover is lifted, for example, by an explosion, a switch actuates an alarm.

U.S. Pat. No. 3,878,507 shows a gas cap alarm whereby a plunger-type switch is actuated by the removal of the gas cap to sound an alarm.

U.S. Pat. No. 4,137,521 deals with an antenna alarm. When a loading coil is unscrewed from the base, a switch is actuated to sound an alarm.

OBJECTS AND SUMMARY OF THE INVENTION

It is an object of the instant invention to provide means for discouraging the theft of submersible pumps.

Another object is to provide an efficient electrical alarm means to detect when a cap is removed from a well casing.

A submersible pump alarm includes an adapter in a well casing for receiving the well water pipe. An extension is threaded into the adapter and a switch inserted therein. A rod cooperates with a switch actuator and a cover on the casing, whereby when the cover is removed, bias which the rod exerts on the actuator is released and the switch energizes an alarm.

BRIEF DESCRIPTION OF THE DRAWINGS

The above and other objects and advantages of the invention will be more readily apparent from reference to the accompanying drawings wherein.

DETAILED DESCRIPTION OF THE INVENTION

Figure 1:
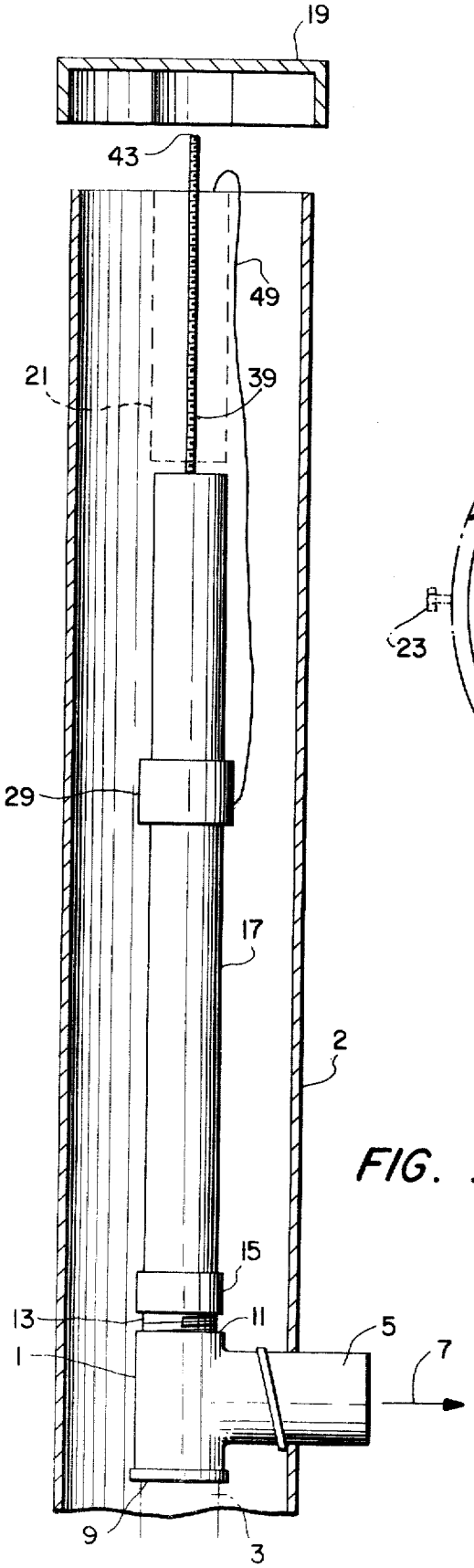
FIG. 1 is a side elevation view, partially in cross-section of a well alarm in place in a well casing.
Figure 2:
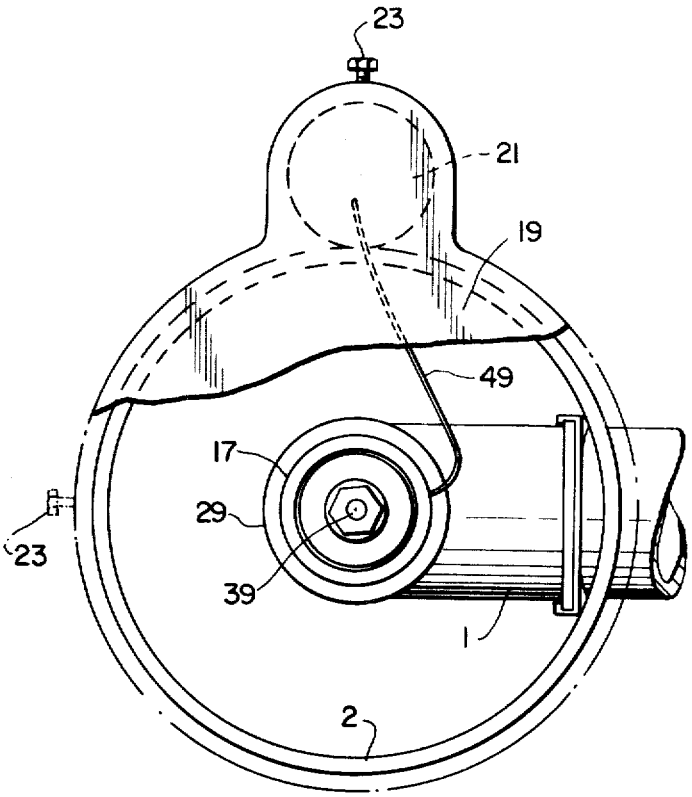
FIG. 2 is a top-plan view, partially in cross-section, of the top of the well casing with the cap thereon.

Referring to FIGS. 1 and 2, a pitless adapter 1 is seen located about four feet below the surface of the ground within a well casing 2. The submersible pump is located approximately another fifty or more feet below the ground to a location in the well water. The pitless adapter is essentially a means wherein water is pumped up from the pump through a well pipe 3 and makes a right-angle turn at the pitless adapter extending through a portion 5 toward a house or the like as shown by an arrow 7. The pitless adapter 1 has female threads at 9 to connect pipe 3 thereto, as well as female threads at 11 for receipt of male threads 13 on a threaded adapter 15. Connected to the threaded adapter 15 is a threaded pipe extension 17 which may be of a suitable polyvinyl chloride material or the like as is the casing and other pipes. The pitless adapter can be of brass, bronze or other suitable corrosion resistant material.

At the top of the casing 2 is a metal cap 19. The cap covers casing 2, as well as a second short tubular member 21 mounted adjacent to and attached to the casing 2. The cap 19 is secured to casing 2 and tubular members 21 by means of appropriate thumb-screws 23. Conventional electrical wiring (not shown) from the submersible pump extends up through the casing, down and out through tube 21 and extends underground into a house.

Figure 3:
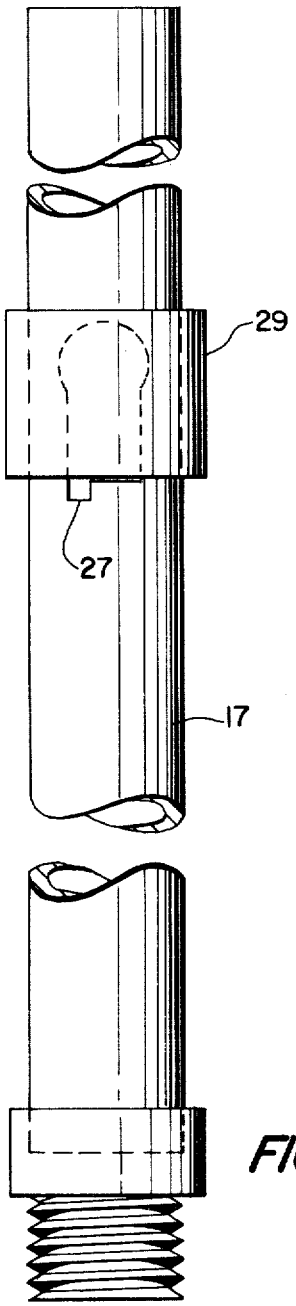
FIG. 3 is a side elevation view of the pipe extension and a switch cover thereover.
Figure 4:
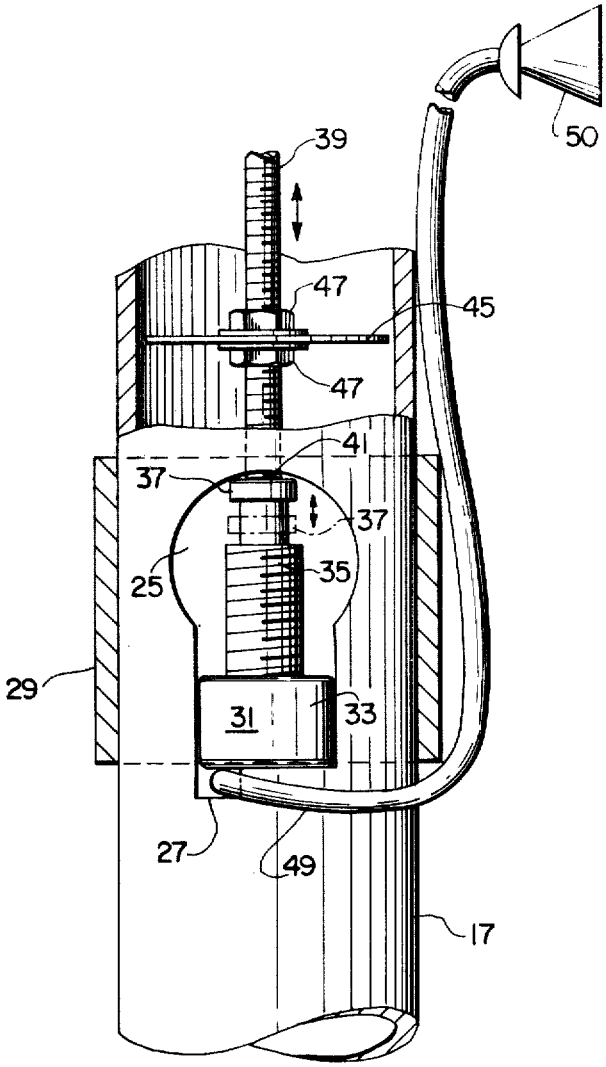
FIG. 4 is a detailed, enlarged view of the switch mechanism in the extension 2.

The extension member 17 extends to a point about one foot from the surface of the ground. With reference to FIGS. 1, 3 and 4, it will be seen that extension 17 has a pair of oppositely positioned key-shaped openings 25 therein with a lower notch 27, the purpose of which will be explained below. Surrounding the opening 25 is a slideable coupling or cover 29. Cover 29 preferably extends to the bottom of the key-shaped opening, leaving the notched opening 27 exposed thereunder.

Positioned within opening 25 is a switch 31. The switch has a base portion 33 which is snugly positioned within the lower portion of the key-shaped opening. Extending upwardly is portion 35 which has an upwardly spring biased push-button actuator 37 reciprocating therein and extending outwardly therefrom. The actuator 37 actuates the switch mechanism in housing 33. Positioned within extension 27 is a threaded rod 39 having a lower end 41 abutting switch actuator 37 and an upper end 43 which cooperates with cap 19 in a manner discussed below. Positioned in one or more locations to rod 39 are washers 45, one of which is seen in FIG. 4 having a pair of nuts 47 thread on rod 39 on either side thereof to locate the washer. The washers 45 will center the rod 39 within extension 17 so that by movement of rod 39 upwardly and downwardly, the switch 31 will be actuated.

Electrical wiring, one line of which is seen at 49 extends out of tube extension 17 upward and out of casing 2 via the downwardly extending tube 21 and through the ground to an appropriate alarm 50 which maybe in a house and/or outside of a house or building where it can best be heard.

When the cover 19 is placed on casing 2 and tube 21, end 43 of rod 39 abuts the inner surface of the cap. As the cap is lowered down and secured on the casing, the rod 39 is depressed, which in turn depresses the swtich actuator 37. The switch 31 is in the normally closed position when the actuator is depressed. Thus, if someone raises the cap 19 and the alarm (not shown) is in the energized position, switch actuator 37 will move upwardly, closing the switch. The alarm will be energized and the proper authorities or individuals will become aware that someone is tampering with the well pump.

When proper maintenance personnel wish to examine or remove the submersible pump, the alarm is deenergized. The cap is removed, and the rod 39 is taken out of tube extension 17. The maintenance personnel then unscrew extension member 17 from the pitless adapter 1. They then insert a conventional extension device which is used to pull the well pipe 3 from the well which in turn will remove the submersible pump from the well. It should be noted that the pitless adapter is of such a size that it can be easily removed from the opening surrounding portion 5, the size of the pitless adapter appearing somewhat larger in FIG. 1 in relation to the casing 2 than its actual size.

While several embodiments of the invention have been described, it will be understood that it is capable of still further modifications and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A submersible pump alarm device comprising:

(a) a switch positioned within a well casing, (b) a cover positioned over the well casing, (c) an adapter connected to well pipe in the casing, (d) an extension connected to said adapter, (e) said switch being positioned in said extension, and (f) means for actuating said switch when said cover is removed, including an actuator on said switch and means cooperating with said actuator and said cover.

2. A device as defined in claim 1 wherein said cooperating means include a rod positioned between said switch and said cover, said actuator being biased in one direction, said cover exerting a force on said actuator through said rod for maintaining said switch in one of two positions.

3. A device as defined in claim 1 wherein said extension has at least one opening in the side thereof, said switch being securely fitted in said opening.

4. A device as defined in claim 3 including a cover, slidably movable over said opening.

5. A device as defined in claim 2 including means for centering said rod in said extension.

6. A method for detecting the tampering with or theft of a submersible well pump comprising:

(a) providing a well casing, the well casing having well pipe therein, and having a cover thereover, (b) connecting an adapter to the well pipe, (c) connecting an extension to said adapter, (d) positioning a switch in said extension, (e) placing a switch actuator means in cooperation with the cover, (f) connecting said switch to an alarm, (g) biasing said actuator means in one direction when the cover is on the well casing, (h) said cover exerting a force on said switch through said actuator means for maintaining said switch in a given position whereby said switch actuates the alarm when the cover is removed.

7. The method of claim 6 including positioning a rod between said switch and said cover.

8. The method of claim 7 including threading said extension in said adapter, and centering said rod in said extension.

* * * * *